US007691796B2

(12) United States Patent
Adams et al.

(10) Patent No.: US 7,691,796 B2
(45) Date of Patent: Apr. 6, 2010

(54) METHOD OF IMPROVING THE COMPATIBILITY OF AN OVERBASED DETERGENT WITH OTHER ADDITIVES IN A LUBRICATING OIL COMPOSITION

(75) Inventors: Christopher J. Adams, Tilehurst (GB); Peter J. Dowding, Wantage (GB)

(73) Assignee: Infineum International Limited (GB)

( * ) Notice: Subject to any disclaimer, the term of this patent is extended or adjusted under 35 U.S.C. 154(b) by 470 days.

(21) Appl. No.: 11/483,691

(22) Filed: Jul. 10, 2006

(65) Prior Publication Data

US 2007/0015672 A1 Jan. 18, 2007

(30) Foreign Application Priority Data

Jul. 14, 2005 (EP) ..... 05270029

(51) Int. Cl.
*C10M 159/12* (2006.01)
*C10M 159/20* (2006.01)

(52) U.S. Cl. ..... 508/460; 508/391; 508/392; 508/395

(58) Field of Classification Search ..... 508/322, 508/329, 336, 339, 388–391, 459, 460, 462, 508/531

See application file for complete search history.

(56) References Cited

U.S. PATENT DOCUMENTS

| | | | | |
|---|---|---|---|---|
| 4,425,249 | A | 1/1984 | Cahill et al. | 252/51.5 R |
| 5,069,804 | A | 12/1991 | Marsh et al. | 252/42.7 |
| 5,804,094 | A | 9/1998 | Alcock et al. | 252/18 |
| 2004/0029747 | A1 * | 2/2004 | Emert et al. | 508/291 |

* cited by examiner

*Primary Examiner*—Glenn A Caldarola
*Assistant Examiner*—Taiwo Oladapo

(57) ABSTRACT

A method of improving the compatibility of an overbased detergent with other additives in a lubricating oil composition. The method includes the step of adding an oil-soluble, hydrocarbyl sulphonic acid to the detergent.

12 Claims, No Drawings

METHOD OF IMPROVING THE COMPATIBILITY OF AN OVERBASED DETERGENT WITH OTHER ADDITIVES IN A LUBRICATING OIL COMPOSITION

The present invention relates to a method of improving the compatibility of an overbased detergent with other additives in a lubricating oil composition, such as other overbased detergents, friction modifiers, anti-oxidants, metal rust inhibitors, viscosity index improvers, corrosion inhibitors, oxidation inhibitors and anti-wear agents. In particular, the invention relates to a method of improving the compatibility of an overbased detergent with friction modifiers present in lubricating oil compositions.

Currently there is a drive in terms of fuel economy for gasoline and diesel engines which has resulted in increased levels of organic friction modifiers being used in lubricating oil compositions; unfortunately, there are compatibility issues between the friction modifiers and overbased detergents, such as overbased calcium sulphonates. The present invention is therefore concerned with improving the compatibility between friction modifiers and overbased detergents in lubricating oil compositions. There are also compatibility problems between different overbased detergents, such as, for example, between an overbased sulphonate detergent and an overbased salicylate detergent. The aim of the present invention is to overcome these problems.

In accordance with the present invention, there is provided a method of improving the compatibility of an overbased detergent with a further additive in a lubricating oil composition; the method including the step of adding an oil-soluble, hydrocarbyl sulphonic acid to the overbased detergent; with the proviso that if the overbased detergent is an overbased phenate detergent, the further additive is not an overbased sulphonate detergent.

The further additive is preferably selected from friction modifiers, anti-oxidants, metal rust inhibitors, viscosity index improvers, corrosion inhibitors, oxidation inhibitors and anti-wear agents.

The friction modifier is preferably selected from: glycerol monoesters; esters of long chain polycarboxylic acids with diols; oxazoline compounds; alkoxylated alkyl-substituted mono-amines, diamines and alkyl ether amines; and molybdenum compounds.

The overbased detergent is preferably an overbased phenate, salicylate or sulphonate. Most preferably, the overbased detergent is an overbased sulphonate or salicylate. The overbased detergent is preferably an overbased calcium detergent.

Preferably the overbased detergent is an overbased sulphonate detergent and the further additive is an overbased salicylate detergent, or the overbased detergent is an overbased salicylate and the further additive is an overbased sulphonate detergent.

In the present invention, the overbased detergent is prepared first and then the oil-soluble, hydrocarbyl sulphonic acid is added to the overbased detergent, i.e. there is post-addition of the oil-soluble, hydrocarbyl sulphonic acid to the overbased detergent.

The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, the hydrocarbyl groups are aliphatic groups, preferably alkyl or alkylene groups, especially alkyl groups, which may be linear or branched.

The oil-soluble, hydrocarbyl sulphonic acid is preferably an oil-soluble, alkyl sulphonic acid. The oil-soluble, hydrocarbyl sulphonic acid is more preferably an oil-soluble, alkyl aryl sulphonic acid such as an alkyl benzene sulphonic acid.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds, sometimes referred to as surfactants.

Detergents generally comprise a polar head with a long hydrophobic tail, the polar head comprising a metal salt of an acidic organic compound. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

Surfactants that may be used include phenates, salicylates, sulphonates, sulphurized phenates, thiophosphonates, and naphthenates and other oil-soluble carboxylates. The metal may be an alkali or alkaline earth metal, e.g., sodium, potassium, lithium, calcium, and magnesium. Calcium is preferred.

Surfactants for the surfactant system of the overbased metal compounds preferably contain at least one hydrocarbyl group, for example, as a substituent on an aromatic ring.

Phenate surfactants may be non-sulphurized or sulphurized. Phenate include those containing more than one hydroxyl group (for example, from alkyl catechols) or fused aromatic rings (for example, alkyl naphthols) and those which have been modified by chemical reaction, for example, alkylene-bridged and Mannich base-condensed and saligenin-type (produced by the reaction of a phenol and an aldehyde under basic conditions).

Preferred phenols on which the phenate surfactants are based may be derived from the formula I below:

I

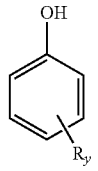

where R represents a hydrocarbyl group and y represents 1 to 4. Where y is greater than 1, the hydrocarbyl groups may be the same or different.

The phenols are frequently used in sulphurized form. Sulphurized hydrocarbyl phenols may typically be represented by the formula II below:

II

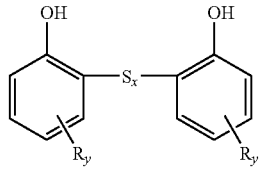

where x is generally from 1 to 4. In some cases, more than two phenol molecules may be linked by $S_x$ bridges.

In the above formulae, hydrocarbyl groups represented by R are advantageously alkyl groups, which advantageously contain 5 to 100, preferably 5 to 40, especially 9 to 15, carbon atoms, the average number of carbon atoms in all of the R groups being at least about 9 in order to ensure adequate solubility in oil. Preferred alkyl groups are dodecyl (tetrapropylene) groups.

In the following discussion, hydrocarbyl-substituted phenols will for convenience be referred to as alkyl phenols.

A sulphurizing agent for use in preparing a sulphurized phenol or phenate may be any compound or element which introduces —$(S)_x$— bridging groups between the alkyl phenol monomer groups, wherein x is generally from 1 to about 4. Thus, the reaction may be conducted with elemental sulphur or a halide thereof, for example, sulphur dichloride or, more preferably, sulphur monochloride. If elemental sulphur is used, the sulphurization reaction may be effected by heating the alkyl phenol compound at from 50 to 250, preferably at least 100° C. The use of elemental sulphur will typically yield a mixture of bridging groups —$(S)_x$— as described above. If a sulphur halide is used, the sulphurization reaction may be effected by treating the alkyl phenol at from −10 to 120, preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulphur is used as the sulphurizing agent, it may be desirable to use a basic catalyst, for example, sodium hydroxide or an organic amine, preferably a heterocyclic amine (e.g., morpholine).

Details of sulphurization processes are well known to those skilled in the art.

Regardless of the manner in which they are prepared, sulphurized alkyl phenols generally comprise diluent and unreacted alkyl phenols and generally contain from 2 to 20, preferably 4 to 14, most preferably 6 to 12, mass % of sulphur, based on the mass of the sulphurized alkyl phenol.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above provided that such substituents do not detract significantly from the surfactant properties of the phenols. Examples of such substituents are methoxy groups and halogen atoms.

Salicylic acids may be non-sulphurized or sulphurized, and may be chemically modified and/or contain additional substituents, for example, as discussed above for phenols. Processes similar to those described above may also be used for sulphurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which overbased detergents may be derived are the substituents represented by R in the above discussion of phenols. In alkyl-substituted salicylic acids, the alkyl groups advantageously contain 5 to 100, preferably 9 to 30, especially 14 to 20, carbon atoms.

Sulphonic acids are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from 7 to 100 or more carbon atoms. They preferably contain from 16 to 80, or 12 to 40, carbon atoms per alkyl-substituted aromatic moiety, depending on the source from which they are obtained.

When neutralizing these alkylaryl sulphonic acids to provide sulphonates, hydrocarbon solvents and/or diluent oils may also be included in the reaction mixture, as well as promoters and viscosity control agents.

Another type of sulphonic acid comprises alkyl phenol sulphonic acids. Such sulphonic acids can be sulphurized. Whether sulphurized or non-sulphurized these sulphonic acids are believed to have surfactant properties comparable to those of sulphonic acids, rather than surfactant properties comparable to those of phenols.

Sulphonic acids also include alkyl sulphonic acids, such as alkenyl sulphonic acids. In such compounds the alkyl group suitably contains 9 to 100, advantageously 12 to 80 especially 16 to 60, carbon atoms.

Carboxylic acids include mono- and dicarboxylic acids. Preferred monocarboxylic acids are those containing 1 to 30, especially 8 to 24, carbon atoms. Examples of monocarboxylic acids are iso-octanoic acid, stearic acid, oleic acid, palmitic acid and behenic acid. Iso-octanoic acid may, if desired, be used in the form of the mixture of $C_8$ acid isomers sold by Exxon Chemicals under the trade name "Cekanoic". Other suitable acids are those with tertiary substitution at the α-carbon atom and dicarboxylic acids with more than 2 carbon atoms separating the carboxylic groups. Further, dicarboxylic acids with more than 35, for example, 36 to 100, carbon atoms are also suitable. Unsaturated carboxylic acids can be sulphurized. Although salicylic acids contain a carboxylic group, for the purposes of the present invention they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the hydrocarbyl-substituted carboxylalkylene-linked phenol type, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708 171.

Further examples of detergents are sulphurized alkaline earth metal hydrocarbyl phenates that have been modified by carboxylic acids such as stearic acid, for examples as described in EP-A-271 262 (LZ-Adibis); and phenolates as described in EP-A-750 659 (Chevron).

The detergent may have a low TBN (i.e. a TBN of less than 50), a medium TBN (i.e. a TBN of 50 to 150) or a high TBN (i.e. a TBN of greater than 150, such as 150-500). "TBN" (Total Base Number) is as measured by ASTM D2896.

The detergent may also contain at least two surfactant groups, such as groups selected from: phenol, sulphonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulphonic acid; an overbased calcium salt of surfactants phenol and carboxylic acid; an overbased calcium salt of surfactants phenol, sulphonic acid and salicylic acid; and an overbased calcium salt of surfactants phenol and salicylic acid.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Preferably, the TBN of the hybrid detergent is at least 300, such as at least 350, more preferably at least 400, most preferably in the range of from 400 to 600, such as up to 500.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include, for example, those described in WO-A-97/46643; WO-A-97/46644; WO-A-97/46645; WO-A-97/46646; and WO-A-97/46647.

The detergent may also be, for example, a sulphurized and overbased mixture of a calcium alkyl phenate and a calcium alkyl salicylate: an example is described in EP-A-750,659, namely:

a detergent-dispersant additive for lubricating oil of the sulphurised and superalkalinised, alkaline earth alkylsalicylate-alkylphenate type, characterised in that:

a) the alkyl substituents of the said alkylsalicylate-alkylphenate are in a proportion of at least 35 wt. % and at most 85 wt. % of linear alkyl in which the number of carbon atoms is between 12 and 40, preferably between 18 and 30 carbon atoms, with a maximum of 65 wt. % of branched alkyl in which the number of carbon atoms is between 9 and 24 and preferably 12 carbon atoms;

b) the proportion of alkylsalicylate in the alkylsalicylate-alkylphenate mixture is at least 22 mole % and preferably at least 25 mole %, and c) the molar proportion of alkaline earth base with respect to alkylsalicylate-alkylphenate as a whole is between 1.0 and 3.5.

The friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxanthates, sulphides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of $$—X—R, \quad (1)$$

-continued

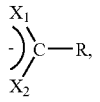

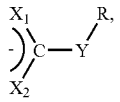

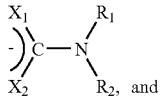

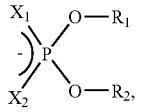

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic- , aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

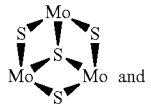

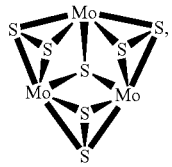

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulphide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. Alternatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

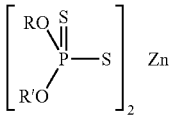

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Basestock | Balance | Balance |

Preferably, the Noack volatility of the fully formulated lubricating oil composition (oil of lubricating viscosity plus all additives) will be no greater than 12, such as no greater than 10, preferably no greater than 8.

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 18 mass %, typically 10 to 15 mass % of the concentrate, the remainder being oil of lubricating viscosity.

The lubricating oils may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service.

Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the NOACK test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from about 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention will now be described by reference to the following examples; however, the present invention is not limited to the following examples:

EXAMPLES

The present invention is illustrated by but in no way limited to the following examples.

Comparative Example 1 includes a 300 TBN calcium sulphonate detergent. The detergent was diluted by 50% using a solvent mixture comprising 95% toluene, 1% water and 4% methanol. Example 2 includes the same detergent but it was modified with 5% of sulphonic acid. The amount of extra sulphonic acid was calculated based on the concentration of soap in the mixture. The modified detergent was prepared by blending the detergent with the sulphonic acid at 40° C. for one hour. The solvent mixture was then stripped off using a rotary evaporator. Example 3 includes the same detergent as Comparative Example 1 except that it was modified with 10% sulphonic acid.

| Description | Comparative Example 1 | Example 2 | Example 3 |
|---|---|---|---|
| 300 TBN Sulphonate detergent | 17.78 | | |
| 300 TBN Sulphonate detergent with extra 5% sulphonic acid | | 17.78 | |
| 300 TBN Sulphonate detergent with extra 10% sulphonic acid | | | 12.60 |
| Dispersant | 35.56 | 35.56 | 35.56 |
| ZDDP | 7.11 | 7.11 | 7.11 |
| Friction Modifier (ET2) | 1.67 | 1.67 | 1.67 |
| Friction Modifier (GMO) | 3.34 | 3.34 | 3.34 |
| Anti-oxidant (aminic) | 7.78 | 7.78 | 7.78 |
| Anti-oxidant (phenolic) | 8.89 | 8.89 | 8.89 |
| Anti-foam | 0.010 | 0.010 | 0.010 |
| Base oil | 17.86 | 17.86 | 23.04 |
| Total | 100.00 | 100.00 | 100.00 |

The formulations were tested for their stability by storing them at 60° C. for 12 weeks and observing them at weekly intervals. The results refer to the number of weeks after which instability manifested itself as haze and/or sediment. A result was considered as a failure for sediment levels of >0.15%. The results are shown below.

| | Comparative Example 1 | Example 2 | Example 3 |
|---|---|---|---|
| Stability- Time to Fail in weeks | 3 | 5 | 7 |

Comparative Example 1 is only stable for 3 weeks whereas Example 2 is stable for 5 weeks and Example 3 is stable for 7 weeks. Therefore the use of sulphonic acid to modify the detergent makes the formulation more stable.

The following formulations were also prepared and tested for their stability:

| | Comparative Example 4 | Example 5 | Comparative Example 6 | Example 7 |
|---|---|---|---|---|
| 300 TBN Sulphonate detergent | 25 | | 25 | 25 |
| 300 TBN Sulphonate detergent with extra 10% sulphonic acid | | 25 | | |
| 171 TBN Salicylate Detergent | 25 | 25 | | |
| 171 TBN Salicylate detergent with extra 10% salicylic acid | | | 25 | |
| 171 TBN Salicylate detergent with extra 10% sulphonic acid | | | | 25 |
| Base oil | 50 | 50 | 50 | 50 |
| Total | 100 | 100 | 100 | 100 |

The results in the stability test are as follows:

| | Comparative Example 4 | Example 5 | Comparative Example 6 | Example 7 |
|---|---|---|---|---|
| Stability-Time to Fail in weeks | 2 | 5 | 0 | At least 12 |

As shown above, the formulations that include a detergent modified with sulphonic acid are more stable.

What is claimed is:

1. A method of improving the compatibility of an overbased detergent with a further additive in a lubricating oil composition; the method including the step of adding an oil-soluble, hydrocarbyl sulphonic acid to the overbased detergent; with the proviso that if the overbased detergent is an overbased phenate detergent, the further additive is not an overbased sulphonate detergent; and wherein said overbased detergent has a TBN of at least 150 mg KOH/g after addition of said oil-soluble hydrocarbyl sulfonic acid.

2. The method as claimed in claim 1, wherein the oil-soluble, hydrocarbyl sulphonic acid is an oil-soluble, alkyl sulphonic acid.

3. The method as claimed in claim 1, wherein the oil-soluble, hydrocarbyl sulphonic acid is an oil-soluble, alkyl aryl sulphonic acid.

4. The method as claimed in claim 1, wherein the further additive is not an overbased detergent.

5. The method as claimed in claim 1, wherein the further additive is selected from friction modifiers, anti-oxidants, metal rust inhibitors, viscosity index improvers, corrosion inhibitors, oxidation inhibitors and anti-wear agents; preferably a friction modifier.

6. The method as claimed in claim 5, wherein the further additive is a friction modifier.

7. The method as claimed in claim 6, wherein the friction modifier is selected from: glycerol monoesters; esters of long chain polycarboxylic acids with diols; oxazoline compounds; alkoxylated alkyl-substituted mono-amines, diamines and alkyl ether amines; and molybdenum compounds.

8. The method as claimed in claim 1, wherein the overbased detergent is an overbased phenate, salicylate or sulphonate.

9. The method as claimed in claim 8, wherein the overbased detergent is an overbased sulphonate or an overbased salicylate.

10. The method as claimed in claim 1, wherein the overbased detergent is an overbased calcium detergent.

11. The method as claimed in claim 1, wherein the overbased detergent is an overbased sulphonate detergent and the further additive is an overbased salicylate detergent.

12. The method as claimed in claim 1, wherein the overbased detergent is an overbased salicylate detergent and the further additive is an overbased sulphonate detergent.

* * * * *